US005688112A

United States Patent [19]

Garay

[11] Patent Number: 5,688,112

[45] Date of Patent: Nov. 18, 1997

[54] ROTOR AXIS ALIGNED TUBE AND OUTLET FOR A PERISTALTIC PUMP SYSTEM

[76] Inventor: Thomas William Garay, 149 Coventry Place NE., Calgary, Alberta, Canada, T3K 4A6

[21] Appl. No.: 605,678

[22] Filed: Feb. 22, 1996

[51] Int. Cl.[6] ..... F04B 43/08

[52] U.S. Cl. ..... 417/477.1; 417/477.12

[58] Field of Search ..... 417/477.1, 477.4, 417/477.12

[56] References Cited

U.S. PATENT DOCUMENTS

| | | | |
|---|---|---|---|
| 2,898,864 | 8/1959 | Japolsky | 417/477.1 |
| 2,987,004 | 6/1961 | Murray | 417/477.12 |
| 3,358,609 | 12/1967 | Worth et al. | 417/477.12 |
| 3,397,739 | 8/1968 | Miller | 417/477.12 |
| 3,433,170 | 3/1969 | Malbec | 417/477.12 |
| 3,542,491 | 11/1970 | Newman | 417/477.12 |
| 4,445,826 | 5/1984 | Tarr . | |
| 4,997,347 | 3/1991 | Roos | 417/477.12 |
| 5,215,450 | 6/1993 | Tamari . | |
| 5,290,158 | 3/1994 | Okada . | |
| 5,350,284 | 9/1994 | Wehling . | |
| 5,354,186 | 10/1994 | Murtuza et al. . | |
| 5,375,984 | 12/1994 | Wehling . | |
| 5,380,173 | 1/1995 | Hellstrom . | |
| 5,388,972 | 2/1995 | Calhoun et al. . | |

FOREIGN PATENT DOCUMENTS

| | | | |
|---|---|---|---|
| 44247 | 12/1893 | Canada . | |
| 320994 | 3/1932 | Canada . | |
| 400028 | 10/1941 | Canada . | |
| 860036 | 1/1971 | Canada . | |
| 950756 | 7/1974 | Canada . | |
| 1232492 | 2/1988 | Canada . | |
| 2058446 | 1/1990 | Canada . | |
| 2048287 | 3/1992 | Canada . | |
| 2073775 | 5/1992 | Canada . | |
| 2070190 | 12/1992 | Canada . | |
| 2110981 | 11/1993 | Canada . | |
| 2063204 | 4/1994 | Canada . | |
| 2123695 | 4/1994 | Canada . | |
| 1331167 | 5/1963 | France | 417/477.1 |

*Primary Examiner*—Charles G. Freay
*Attorney, Agent, or Firm*—Terrence N. Kuharchuk

[57] ABSTRACT

The present invention relates to a pump utilizing multiple tubes that are arranged helically and with the ends of the tubes oriented axially and not tangential to the drive shaft. Operation of the pump is achieved by rotation of the drive shaft. Rollers are positioned on the shaft such that the compressible tubes are compressed to the point where fluid cannot move within the tubes past the line of compression. The lines of compression move along the tubes by rotation of the shaft. Due to the helical arrangement of the tubes the lines of compression also move axially along the shaft. The fluid enters the tubes at the entrance portion of the tubes and is forced through the tubes due to the moving lines of compression and finally exit the tubes at the exit portion of the tubes. Continued rotation of the shaft causes continuous pumping of the fluid. This results in a very economical and compact pump for use in confined spaces or requiring axial flow. The multiple tubes also provide for a high rate of flow.

19 Claims, 3 Drawing Sheets

ROTOR AXIS ALIGNED TUBE AND OUTLET FOR A PERISTALTIC PUMP SYSTEM

The invention relates to a peristaltic pump wherein a multiple of rollers compress a multiple of tubes arranged helically or circumferentially for the pumping of fluids therethrough.

BACKGROUND OF THE INVENTION

There are many peristaltic pumps available which are used for the pumping of fluids. Some pumps utilize at least one compressible tube, and preferably single tubes and some simultaneously pump multiple tubes. All of the pumps transmit fluid tangentially to the axis of rotation of the drive shaft. This action is impractical in confined spaces such as wells drilled in the ground or where axial flow is required.

One type of pump is described and illustrated in Canadian Patent No. 320,994 of Warner. This patent describes a single tube helically arranged within an outer cylinder. The inlet and outlet of the tube are oriented tangentially to the shaft and as a result the pump could not be used efficiently in a confined space or where axial flow is required.

Another type of pump is described and illustrated in Canadian Patent No. 2,123,695 of Minarik. This patent describes a multiple tube pump with the tubes arranged circumferentially to the rotating shaft axis. The inlet and outlet of the tube are also oriented tangentially to the shaft and as a result the pump also could not be used efficiently in a confined space or where axial flow is required.

The present invention relates to a pump utilizing multiple tubes that are arranged helically and with the ends of the tubes oriented axially and not tangential to the drive shaft. This results in a very economical and compact pump for use in confined spaces or requiring axial flow. The multiple tubes also provide for a high rate of flow.

SUMMARY OF THE INVENTION

In accordance to one aspect of the invention, there is provided a peristaltic pump for moving fluid therethrough. The pump comprises an outer cylinder containing at least one compressible tube, and preferably a multiple of compressible tubes. The tubes are in contact with a means for compressing the tubes that is driven by a rotatably mounted shaft. The tubes are arranged helically within the outer cylinder. Rotation of the shaft causes the motion of fluids through the tubes.

In accordance to another aspect of the invention, there is provided a peristaltic pump for moving fluid therethrough. The pump comprises an outer cylinder containing a multiple of compressible tubes. The tubes are in contact with a means for compressing the tubes that is driven by a rotatably mounted shaft. The tubes are arranged circumferentially within the outer cylinder. One end of each tube is connected to an entrance cavity and the other end of each tube is connected to an exit cavity. Rotation of the shaft causes the motion of fluids through the tubes.

Either pump may have the flow entrance and exit portions of the tube oriented axially. The means for compressing may be a multiple of rollers and the rollers may be supported by the shaft with bearings.

Either pump may also have the provision of being able to remove the means for compressing and shaft by simply urging them out of the cylinder.

Either pump may also have a shaft that is supported by bearings within said outer cylinder.

BRIEF DESCRIPTION OF THE DRAWINGS

Further features and advantages of the invention will become apparent from the text set forth below, and the accompanying drawings.

DETAILED DESCRIPTION OF THE PREFERRED EMBODIMENT

Figure 1:
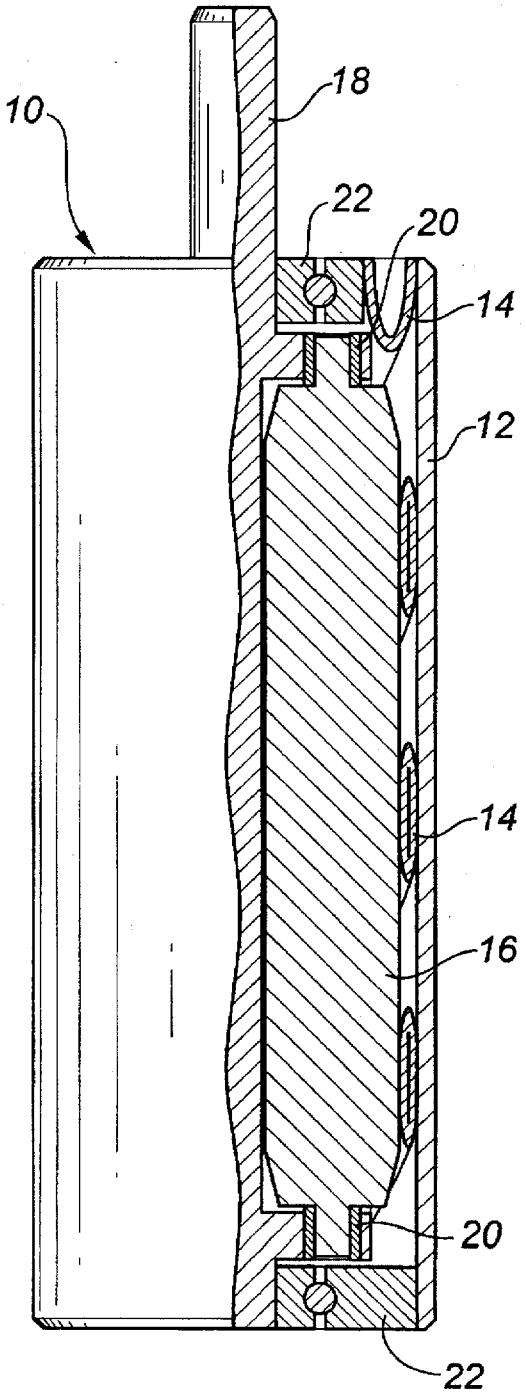
FIG. 1 is a side view of the pump in accordance with the first embodiment of the invention shown in partial section with the shaft supported with bearings and showing the use of one compressible tube therein.
Figure 2:
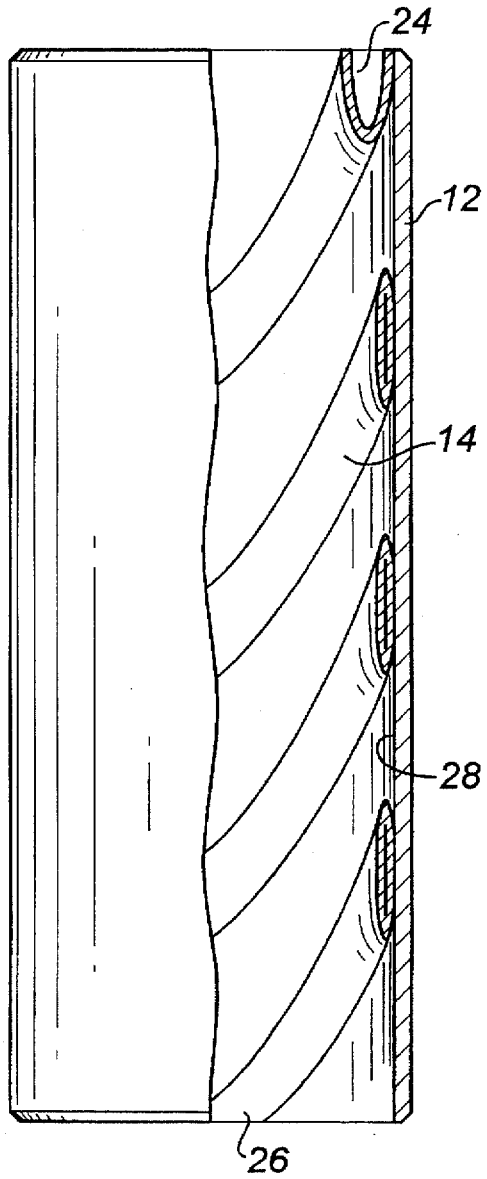
FIG. 2 is a partial section of the tubes of FIG. 1 arranged helically within the outer cylinder.
Figure 3:
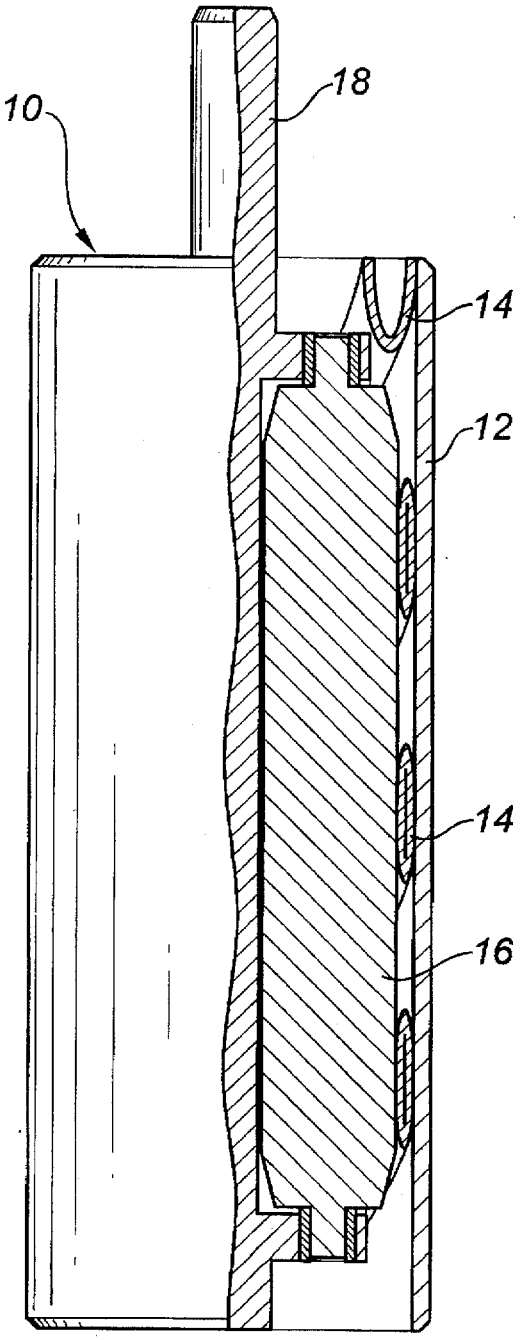
FIG. 3 is a side view of the anchor pump in accordance with the first embodiment of the invention shown in partial section with the shaft and the rollers being removable from the outer cylinder.
Figure 4:
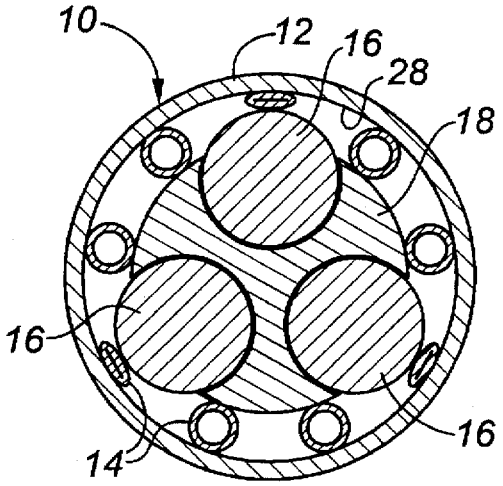
FIG. 4 is a cross-section of the pump in accordance with the preferred first embodiment of the invention showing the use of a multiple of compressible tubes therein.

FIG. 1, 2 and 3 show the first embodiment of a pump 10 with the outer cylinder 12 containing at least one compressible tube 14. In the preferred first embodiment, as shown in FIG. 4, the outer cylinder 12 contains a multiple of compressible tubes 14. The tubes 14 are arranged helically within the outer cylinder 12. The rollers 16 are shown to compress the compressible tubes 14 and supported by the shaft 18 by roller bearings 20. The shaft 18 is also supported with bearings 22 within the outer cylinder 12.

FIG. 2 shows a single tube 14, while FIG. 4 shows a multiple tubes 14, arranged helically within the outer cylinder 12. The fluid enters the tube 14 at the entrance portion of the tube 26 and moves around the circumference of the outer cylinder 12 as well as axially along the outer cylinder 12 to effect the pumping operation. The fluid finally exits the tube 14 at the exit portion of the tube 24.

FIG. 3 shows a pump 10 with the shaft 18 and the rollers 16 being removable from within the outer cylinder 12. The shaft 18 and rollers 16 centralize within and with respect to the outer cylinder 12 as a result of the multiple rollers being equally spaced circumferentially within the outer cylinder 12 and being in contact with the tube 14.

FIG. 4 depicting the preferred first embodiment of the invention shows the pump 10 with the tubes 14 in contact with the inner wall of the outer cylinder 28. The rollers 16 compress the tubes 14 to keep fluid from flowing past the line of contact.

Operation of the first preferred embodiment of the pump 10 is achieved by rotation of the shaft 18. The rollers 16 are positioned on the shaft 18 such that the compressible tubes 14 are compressed to the point where fluid cannot move within the tubes 14 past the line of compression. The lines of compression move along the tubes 14 by rotation of the shaft 18. Due to the helical arrangement of the tubes 14 the lines of compression also move axially along the shaft 18. The fluid enters the tubes at the entrance portion of the tubes 26 and is forced through the tubes 14 due to the moving lines of compression and finally exit the tubes 14 at the exit portion of the tubes 24. Continued rotation of the shaft 18 causes continuous pumping of the fluid.

Figure 5:
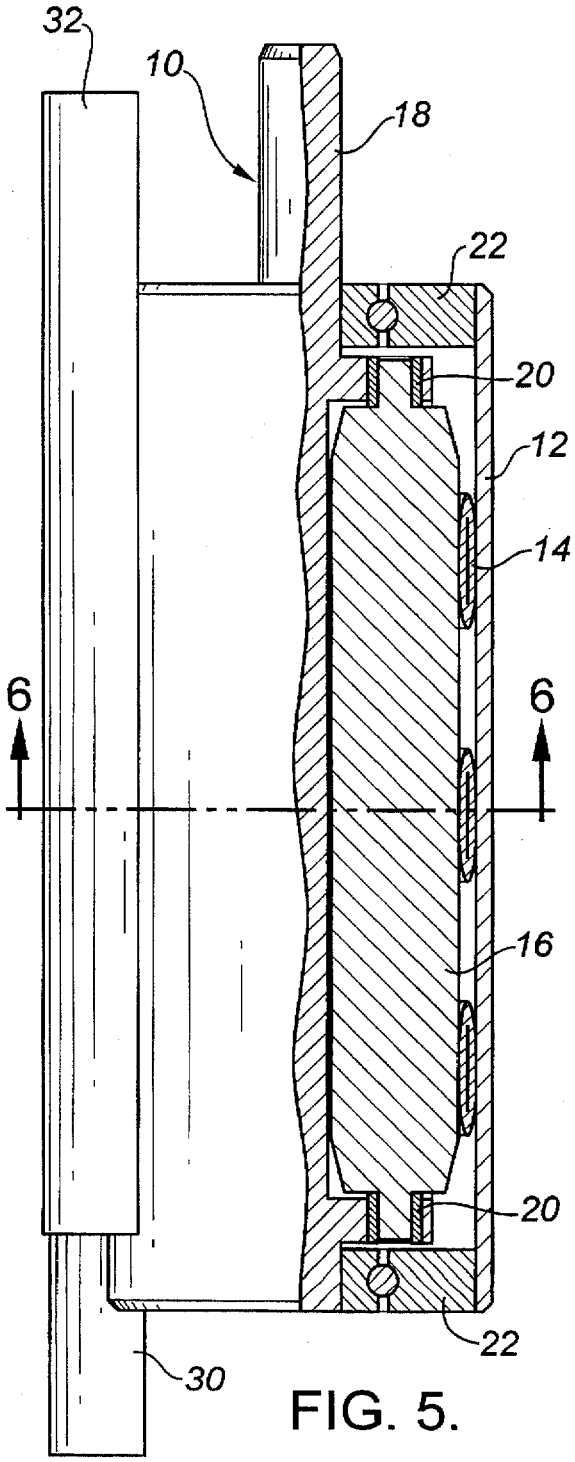
FIG. 5 is a side view of the anchor pump in accordance with the second embodiment of the invention shown in partial section with the shaft supported with bearings.

FIG. 5 shows an alternative embodiment of the pump 10 with the outer cylinder 12 containing the compressible tubes 14. The tubes 14 are arranged circumferentially within the outer cylinder 12. The rollers 16 are shown to compress the compressible tubes 14 and supported by the shaft 18 by roller bearings 20. The shaft 18 is also supported with bearings 22 within the outer cylinder 12. The fluid enters the pump 10 through the entrance cavity 30. One end of the tubes 14 are connected to the entrance cavity 30. The other end of the tubes 14 are connected to the exit cavity 32. The fluid flows from the entrance cavity 30 into the tubes 14 and then into the exit cavity 32 and finally exits the pump 10 axially from the exit cavity 32.

Figure 6:
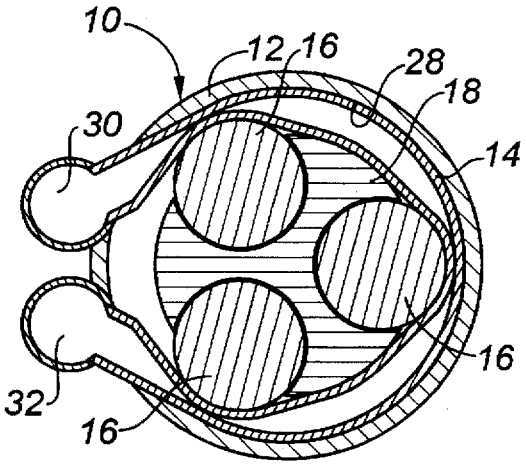
FIG. 6 is a section taken on the line 6—6 of FIG. 5.

FIG. 6 shows the pump 10 with the tubes 14 in contact with the inner wall of the outer cylinder 28. The rollers 16 compress the tubes 14 to keep fluid from flowing past the line of contact.

Operation of the second embodiment of the pump 10 is achieved by rotation of the shaft 18. The rollers 16 are positioned on the shaft 18 such that the compressible tubes 14 are compressed to the point where fluid cannot move within the tubes 14 past the line of compression. The lines of compression move circumferentially along the tubes 14 by rotation of the shaft 18. The fluid enters the pump 10 through the entrance cavity 30. One end of the tubes 14 are connected to the entrance cavity 30. The other end of the tubes 14 are connected to the exit cavity 32. The fluid flows from the entrance cavity 30 into the tubes 14 and is forced through the tubes 14 due to the moving lines of compression it then flows into the exit cavity 32 and finally exits the pump 10 axially from the exit cavity 32. Continued rotation of the shaft 18 causes continuous pumping of the fluid.

Although the invention has been described in conjunction with specific embodiments thereof, the present invention is not limited to the features of these embodiments, but includes all variations and modifications within the scope of the claims.

I claim:

1. A compressible tube pump for pumping fluids comprising an outer cylinder having a first end and a second end and containing at least one compressible tube having a flow entrance portion associated with the first end of said outer cylinder and a flow exit portion associated with a second end surface of said outer cylinder such that the fluids pass out of said tube through the second end surface generally axially, wherein said tube is in contact with a means for compressing the tube that is driven by a rotatably mounted shaft with said tube being arranged helically within said outer cylinder.

2. The pump of claim 1 wherein the flow entrance portion is associated with a first end surface of said outer cylinder such that the fluids pass into said tube through the first end surface generally axially.

3. The pump of claim 2 wherein said outer cylinder contains a multiple of compressible tubes.

4. The pump of claim 3 wherein said shaft is supported by bearings within said outer cylinder.

5. The pump of claim 4 wherein the means for compressing is a multiple of rollers.

6. The pump of claim 5 wherein said rollers are supported by said shaft with bearings.

7. The pump of claim 3 wherein the said shaft and means for compressing are removable from within said outer cylinder.

8. The pump of claim 7 wherein the means for compressing is a multiple of rollers.

9. The pump of claim 8 wherein the rollers are supported by the shaft using bearings.

10. A compressible tube pump comprising an outer cylinder containing a multiple of compressible tubes in contact with a means for compressing the tubes that is driven by a rotatably mounted shaft with said tubes being arranged circumferentially within said outer cylinder and having one end of each said compressible tube connected to portions defining an entrance cavity and the other end of each said compressible tube connected to portions defining an exit cavity.

11. The pump of claim 10 wherein said shaft is supported by bearings within said outer cylinder.

12. The pump of claim 11 wherein the portions defining an entrance cavity and portions defining an exit cavity are oriented axially.

13. The pump of claim 12 wherein the means for compressing is a multiple of rollers.

14. The pump of claim 13 wherein said rollers are supported by said shaft with bearings.

15. The pump of claim 10 wherein the said shaft and means for compressing are removable from within said outer cylinder.

16. The pump of claim 15 wherein the portions defining an entrance cavity and portions defining an exit cavity are oriented axially.

17. The pump of claim 16 wherein the means for compressing is a multiple of rollers.

18. The pump of claim 17 wherein the rollers are supported by the shaft using bearings.

19. A compressible tube pump for pumping fluids comprising an outer cylinder having a first end and a second end and containing at least one compressible tube having a flow entrance portion associated with a first end surface of said outer cylinder such that the fluids pass into said tube through the first end surface generally axially and a flow exit portion associated with the second end of said outer cylinder, wherein said tube is in contact with a means for compressing the tube that is driven by a rotatably mounted shaft, with said tube being arranged helically within said outer cylinder.

* * * * *

UNITED STATES PATENT AND TRADEMARK OFFICE

CERTIFICATE OF CORRECTION

PATENT NO. : 5,688,112
DATED : November 18, 1997
INVENTOR(S) : thomas William Garay It is certified that error appears in the above-identified patent and that said Letters Patent is hereby corrected as shown below:

Title page, item [54] and col. line 1, insert -- INLET--between "TUBE" and AND"--.

| | |
|---|---|
| Column 1, lines 11-12 | Delete "at least one compressible tube, and preferably" |
| Column 1, line 31 | After "utilizing" insert --at least one compressible tube, and preferably-- |
| Column 2, line 12 | Delete the word "anchor" |
| Column 2, line 19 | Delete the word "anchor" |
| Column 2, line 37 | Insert --of-- between "multiple" and "tubes" |

UNITED STATES PATENT AND TRADEMARK OFFICE

CERTIFICATE OF CORRECTION

PATENT NO. : 5,688,112

DATED : Nov. 18, 1997

INVENTOR(S) : Thomas William Garay

It is certified that error appears in the above-identified patent and that said Letters Patent is hereby corrected as shown below:

| | |
|---|---|
| Column 2, lines 50-51 | Insert --,-- after "4" in line 50 and insert --,-- after "invention" in line 51 |
| Column 2, line 55 | Insert --preferred-- before the word "first" and delete the word "preferred" after the word "first" |

Signed and Sealed this

Seventh Day of April, 1998

Bruce Lehman

*Attest:*

BRUCE LEHMAN

*Attesting Officer*

*Commissioner of Patents and Trademarks*